US008202063B2

(12) United States Patent
Gilpatrick et al.

(10) Patent No.: US 8,202,063 B2
(45) Date of Patent: Jun. 19, 2012

(54) BASE PLATE FOR POWER EQUIPMENT CONFIGURED FOR MOUNTING AN ENGINE AND A TOOL

(75) Inventors: Richard J. Gilpatrick, Whitewater, WI (US); Peter A. Chiello, Waukesha, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 86 days.

(21) Appl. No.: 12/433,622

(22) Filed: Apr. 30, 2009

(65) Prior Publication Data

US 2010/0278662 A1 Nov. 4, 2010

(51) Int. Cl.
*F04B 53/22* (2006.01)
*F04B 17/05* (2006.01)

(52) U.S. Cl. ..... 417/234; 417/360; 417/364

(58) Field of Classification Search ..... 417/234, 417/360, 364; 56/16.9, 16.7, 16.8, 17.1, 56/320.1, 320.2; 74/16
See application file for complete search history.

(56) References Cited

U.S. PATENT DOCUMENTS

| | | | | | |
|---|---|---|---|---|---|
| 2,889,641 | A | * | 6/1959 | Rechenberg | 37/243 |
| 3,286,376 | A | * | 11/1966 | Wildes | 37/243 |
| 3,375,644 | A | * | 4/1968 | Harper | 56/16.8 |
| 3,675,851 | A | * | 7/1972 | Merfeld et al. | 239/318 |
| 4,164,112 | A | * | 8/1979 | Jackson et al. | 56/295 |
| 4,442,661 | A | * | 4/1984 | Stuart | 56/16.9 |
| 4,583,921 | A | | 4/1986 | Wolff et al. | |
| 4,926,622 | A | * | 5/1990 | McKee | 56/16.8 |
| 5,312,044 | A | * | 5/1994 | Eaton | 239/225.1 |
| 5,494,414 | A | * | 2/1996 | Steinhart et al. | 417/360 |
| 5,653,584 | A | * | 8/1997 | Mazzucato et al. | 417/360 |
| 5,823,752 | A | | 10/1998 | Hoenisch et al. | |
| 5,890,413 | A | | 4/1999 | Bayer et al. | |
| 5,916,348 | A | | 6/1999 | Lanfredi | |
| 5,975,863 | A | * | 11/1999 | Mazzucato | 417/269 |
| 5,980,220 | A | | 11/1999 | Mazzucato et al. | |
| 6,056,515 | A | | 5/2000 | Cuneo | |
| 6,112,641 | A | | 9/2000 | Magri et al. | |
| 6,431,844 | B1 | | 8/2002 | Dexter et al. | |
| 6,474,958 | B2 | | 11/2002 | Nathan | |
| 6,750,556 | B2 | | 6/2004 | Sodemann et al. | |
| 6,952,056 | B2 | | 10/2005 | Brandenburg et al. | |
| 6,998,725 | B2 | | 2/2006 | Brandenburg et al. | |
| 7,083,120 | B2 | | 8/2006 | Gilpatrick et al. | |
| 7,125,228 | B2 | | 10/2006 | Dexter et al. | |
| D532,793 | S | | 11/2006 | Reverberi | |
| D536,005 | S | | 1/2007 | Reverberi | |
| D539,817 | S | | 4/2007 | Reverberi | |

(Continued)

OTHER PUBLICATIONS

Karcher 1750G (1.884.712) Parts List as of Jul. 2001 (http://www.m-and-d.com/pdfs/Karcher/K-1750G-Parts-List.pdf).*
Karcher K 1750 G Spare Parts List, 27 pages.
DIRTBLASTER™ 1750 G, 2 pages, Alfred Karcher, Inc., Carol Stream, IL.

(Continued)

*Primary Examiner* — Charles Freay
*Assistant Examiner* — Nathan Zollinger
(74) *Attorney, Agent, or Firm* — Foley & Lardner LLP

(57) ABSTRACT

A pressure washer includes an engine having a vertical shaft and a pump designed to be powered by the engine. Additionally, the pressure washer includes a base plate, where the engine is coupled to the base plate with a first set of fasteners and the pump is independently coupled to the base plate with a second set of fasteners. The base plate is designed to allow the engine to be unfastened and removed from the base plate without also unfastening the pump.

16 Claims, 4 Drawing Sheets

U.S. PATENT DOCUMENTS

| | | | | |
|---|---|---|---|---|
| 7,472,284 | B2 | 12/2008 | Shipp | |
| 7,604,246 | B2 * | 10/2009 | Sodemann et al. | 280/47.315 |
| 2006/0024173 | A1 | 2/2006 | Rocchi et al. | |
| 2006/0290084 | A1 * | 12/2006 | Sodemann et al. | 280/47.17 |
| 2007/0207042 | A1 * | 9/2007 | Hahn et al. | 417/234 |

OTHER PUBLICATIONS

Comet Consumer Products, VRX Consumer Series Pumps and Accessories Price List, downloaded from www.cometpump.com, 4 pages, undated, but available for download prior to Jan. 18, 2012.

* cited by examiner

BASE PLATE FOR POWER EQUIPMENT CONFIGURED FOR MOUNTING AN ENGINE AND A TOOL

BACKGROUND

The present invention relates generally to the field of outdoor power equipment. More specifically the present invention relates to using an intermediate mounting plate to couple an engine and a powered tool, such as a pump of a pressure washer system.

A standard lawn and garden flange mounting system is typically associated with a vertically-mounted pressure washer pump. During servicing , the standard flange mounting system may require a user to detach a combined pump and engine from a frame or support structure, and decouple the pump from the engine, before the engine (or pump) can be serviced individually. Other forms of outdoor power equipment may require similar steps for servicing.

SUMMARY

One embodiment of the invention relates to a pressure washer. The pressure washer includes an motor and a pump designed to be powered by the motor. Additionally, the pressure washer includes a base plate. The motor is coupled to the base plate with a first set of fasteners. And, the pump is independently coupled to the base plate with a second set of fasteners. The base plate is designed to allow the motor to be unfastened and removed from the base plate without also unfastening the pump.

Another embodiment of the invention relates to an engine powered product, including a base plate having a surface with a protrusion extending from the surface. The protrusion has an opening formed in the protrusion. The base plate includes a first aperture and a second aperture, where the first aperture is different from the second aperture. A combustion engine is fastened to the base plate through the first aperture and a tool is fastened to the base plate through the second aperture. The engine has a vertical crankshaft that extends through the opening in the protrusion to engage the tool. The engine may be unfastened from the base plate without also unfastening the tool from the base plate.

Yet another embodiment of the invention relates to a method of manufacturing power equipment. The method includes a number of steps. One step includes providing an engine having a vertical crankshaft, a tool, and a base plate having an opening. Another step includes fastening the tool to a first side of the base plate using a first fastener. Yet another step includes fastening the engine to a second side of the base plate using a second fastener. The crankshaft extends through the opening in the base plate. Also, the engine is fastened to the base plate so that the engine may be unfastened and removed without unfastening the tool. Another step includes orienting the tool and the engine so that the vertical crankshaft drives the tool.

Alternative exemplary embodiments relate to other features and combinations of features as may be generally recited in the claims.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION OF THE EXEMPLARY EMBODIMENTS

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
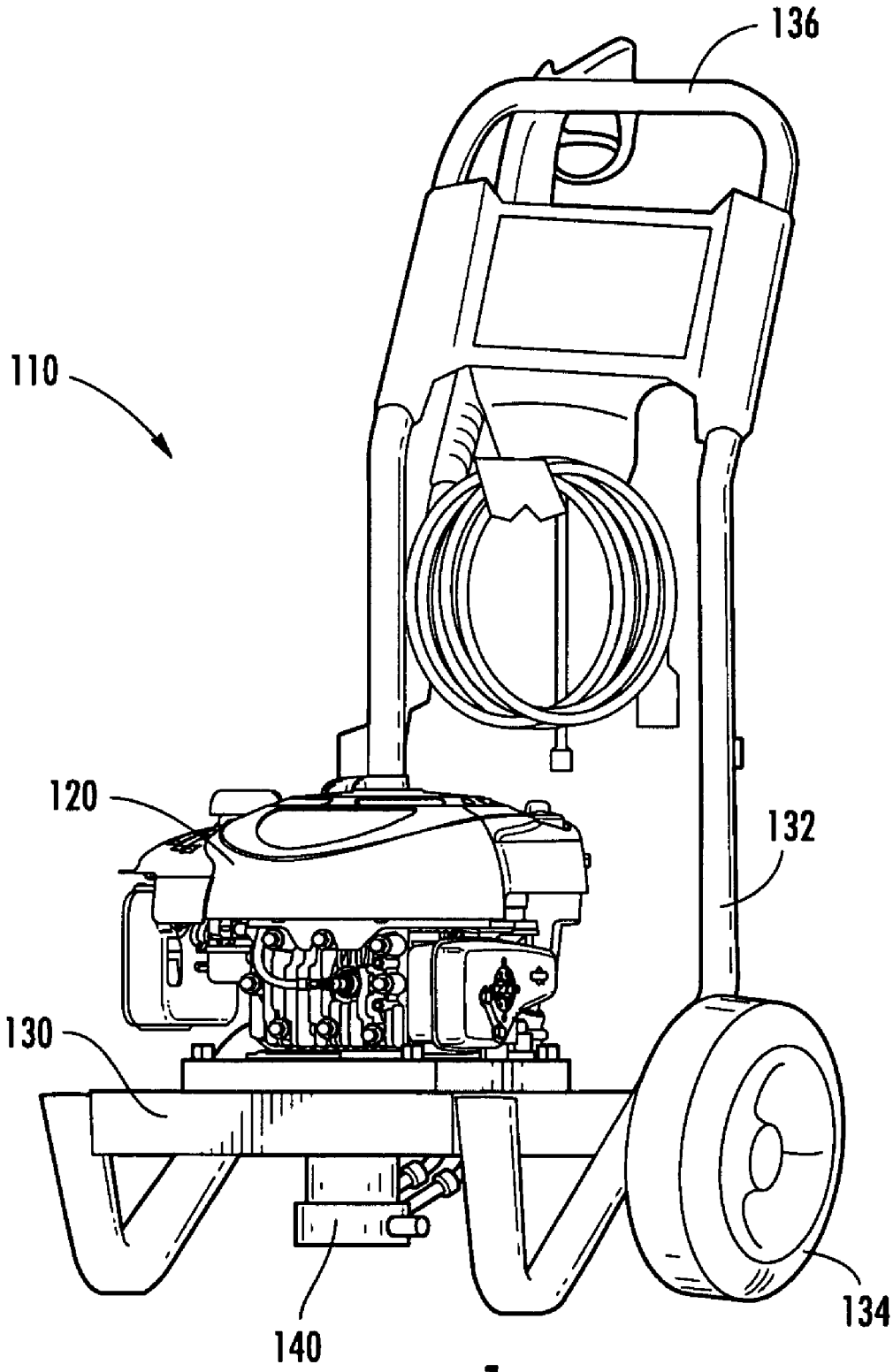
FIG. 1 is a perspective view of power equipment according to an exemplary embodiment.

FIG. 1 shows power equipment in the form of a pressure washer system 110, including a motor or an engine and a powered tool mounted to opposite sides of a base plate 130. In the exemplary embodiment depicted in FIG. 1, the engine is shown as a vertically-shafted, combustion engine 120, and the tool is shown as an axial cam water pump 140. The base plate 130 is coupled to a support frame 132, partially formed from a network of tubular members. While FIG. 1 shows the pressure washer system 110, the invention may be embodied in a broad range of power equipment, including lawn mowers, floor buffers, scrubbers, waxers, rotary sanding machines, street sweepers, and other power equipment where a motor may be coupled to a tool via an intermediate mounting plate.

The support frame 132 of system 110 includes wheels 134 and a handlebar 136. A user can employ the handlebar 136 to pivot the system 110 about the wheels 134, so that the system 110 can be rolled to a desired location. Further, when tilted fully back, such that the handlebar 136 rests on the ground, the center of gravity of the system 110 is located between the wheels 134 and the handlebar 136 so that a user can access the underside of the base plate 130. Other exemplary support frames 132 include members of various shapes and configurations (e.g., a framework of solid, rectangular beams).

Figure 2:
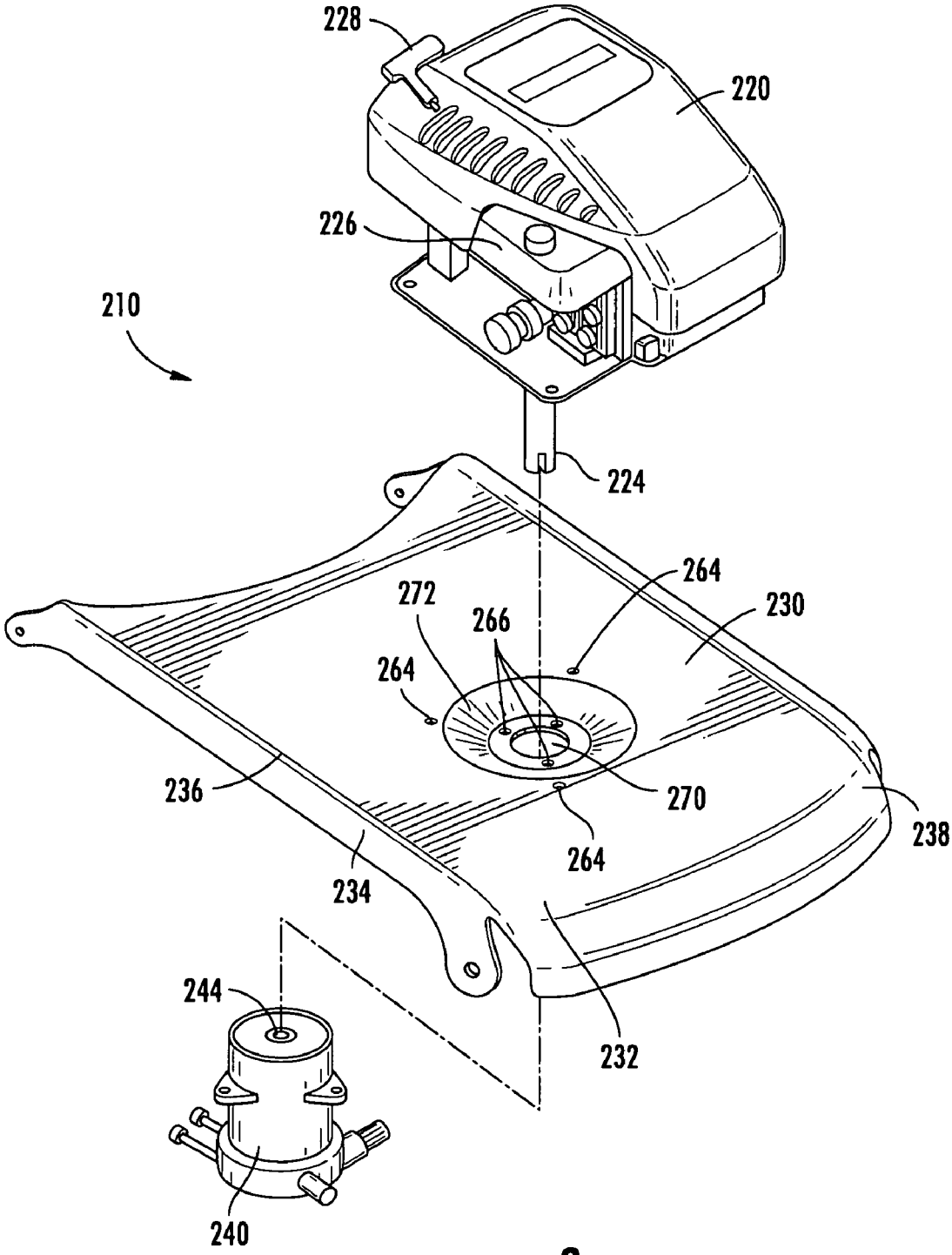
FIG. 2 is an exploded perspective view of an integrated pump, engine, and plate coupling system according to an exemplary embodiment.
Figure 3:
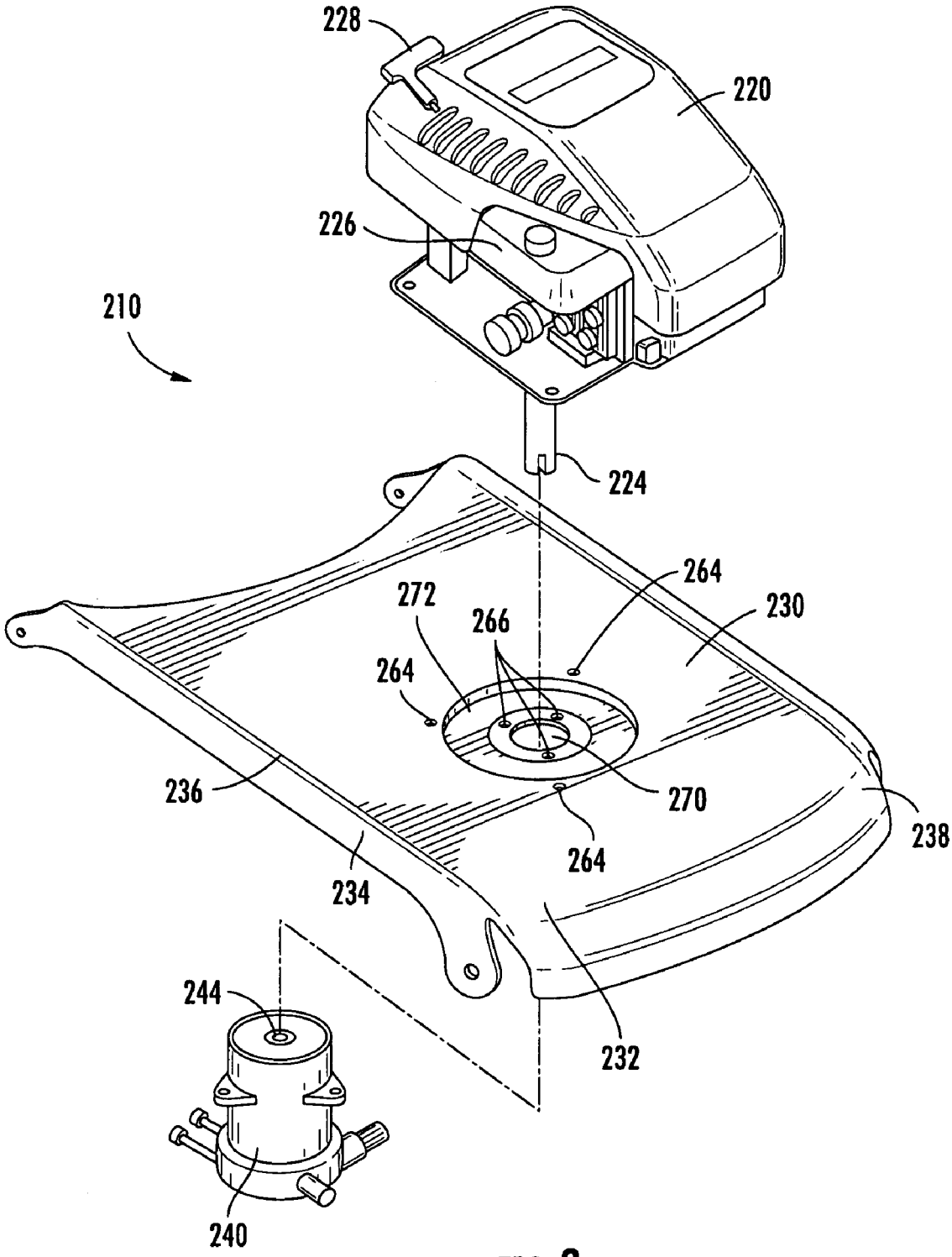
FIG. 3 is an exploded perspective view of an integrated pump, engine, and plate coupling system according to another exemplary embodiment.
Figure 4:
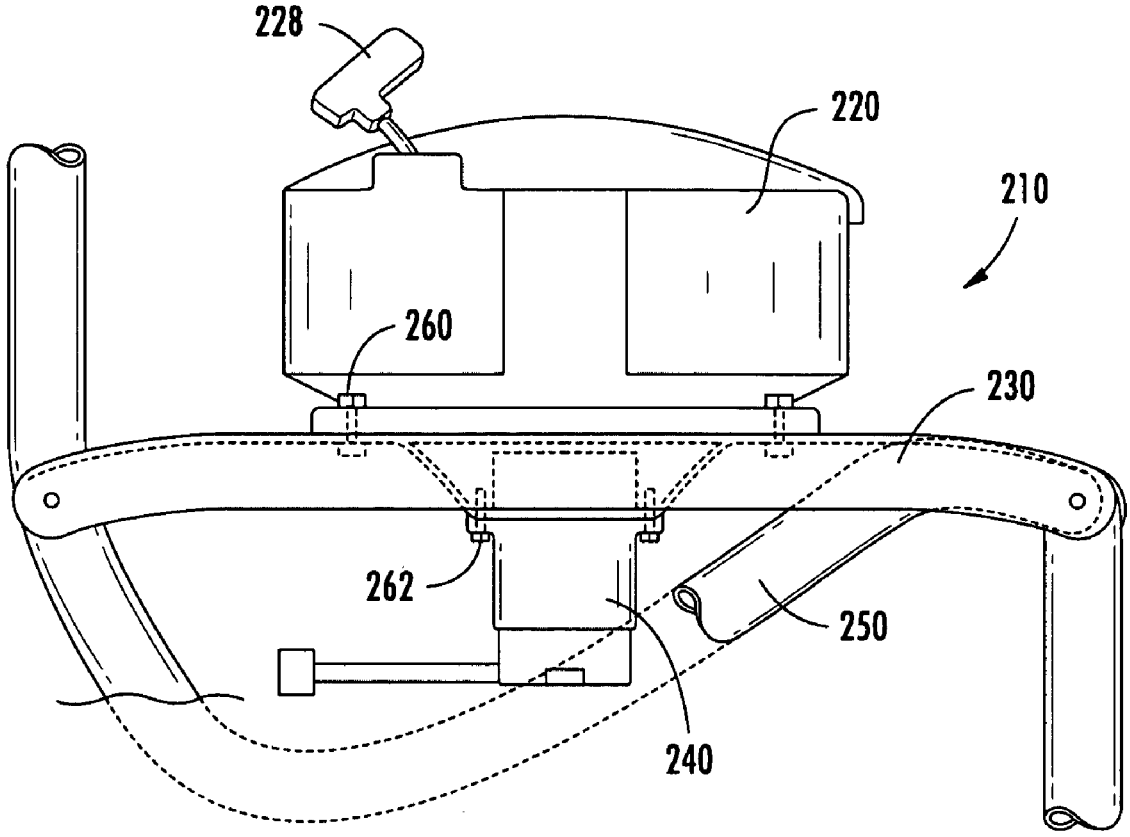
FIG. 4 is a side view of the coupling system of FIG. 2.

FIGS. 2-3 both show an exemplary embodiment, where FIG. 2 shows an exploded perspective view of a pressure washer system 210 including a combustion engine 220, a base plate 230, and a pump 240. FIG. 4 shows a side view of the system 210, where the base plate is fastened to a frame 250. The engine 220 is coupled to the base plate 230 with a first set of fasteners 260, the pump 240 is independently coupled to the base plate 230 with a second set of fasteners 262, where fastening holes 264, 266 (or apertures) (see FIGS. 2-3) on the base plate are arranged to allow the engine 220 to be unfastened and removed from the base plate 230 without also unfastening the pump 240 from the base plate 230.

In the embodiment of FIGS. 2-3 the base plate 230 is shown as an integral sheet of solid material having an opening 270 near the center. Surrounding the opening 270 is a protrusion 272 that protrudes from the sheet. The protrusion 272 serves as a separator to provide mounting space between the base of the engine 220 and the top of the pump 240. The separator protrusion 272 in FIG. 2 tapers from top to bottom and the tapered structure provides support to withstand and absorb forces, such as might occur if the pump 240 were to hit a rock while being wheeled about a yard. The separator protrusion 272 in FIG. 3 shows a straight-sided protrusion, without tapering. In some embodiments, the separator protrusion 272 extends above the surrounding base plate to lift the engine 220 above the pump 240. In still other embodiments, the separator protrusion 272 may have a geometry that is not conical, such as a box shape, a pyramid shape, an oval depression, or other shapes.

Certain features of the base plate 230 provide for structural reinforcement and rigidity. For example, the base plate 230 includes a flange 234, a crease 236, and a bend 238. The crease 236 spans the length of the base plate 230 and helps to prevent the base plate 230 from bending or warping in reaction to the weight of the engine 220 and the pump 240. Other embodiments of the base plate 230 have additional bends, creases, waves, curls, bumps, baffles, flanges, and like structures to increase platform rigidity along particular axes. In some embodiments, the base plate 230 is integrally formed as one piece, while in other embodiments, separate reinforcement structure and additional components are attached to form the base plate 230. In some embodiments, the base plate 230 is formed from a grate, mesh, or like surface structure having open areas, removing excess weight and material.

In some embodiments, the base plate 230 is formed from a metal, such as aluminum, aluminum alloy, steel, or other metals. Such metals may be cast, pressed, rolled, drawn, or otherwise formed. In other embodiments, the base plate 230 is formed from a tough plastic, such as polycarbonate, nylon, or acrylonitrile butadiene styrene; or a composite material, such as a particulate composite, discontinuous fiber composite, or a multi-directional (layered) continuous fiber composite. Plastics and discontinuous composites may be injection molded, heat pressed, or formed in other ways, while continuous fiber composites may be laid, wound, stretched or otherwise formed in ordered plies. In some embodiments, the base plate 230 includes a combined-material structure, such as a plastic body with steel-reinforced fastening apertures.

Dimensions of the base plate vary depending upon characteristics of the engine 220 (e.g., weight and size) as well as upon the type of tool (e.g., motorized pump, lawn mower blade or drive assembly, buffer wheel, etc.). However, the base plate 230 should preferably have a thickness, strength, toughness, and rigidity sufficient to support the combined weight of the engine 220 (with fuel) and the tool, while withstanding vibratory fatigue loading of the engine 220 and tool in operation, as well as provide a sufficient factor of safety. Additionally, because the engine 220 and tool are fastened to the base plate 230 (and not to each other), the base plate 230 should be able to absorb and withstand shear loading caused by changes in rotational inertia of the engine 220 and tool.

Referring to FIGS. 2-4, the pressure washer system 210 includes the engine 220 (shown as a vertically-mounted combustion engine) coupled to the top side of the base plate 230, where the engine 220 includes a fuel tank 226, a recoil starter 228, a crank case and a vertical shaft 224, with other engine components. In other embodiments, engine 220 includes an automatic starter. Some engines that may be used include Briggs & Stratton 10-series engine, Briggs & Stratton 12-series engine, and Briggs & Stratton W-14 engine. In other embodiments, an electric motor receiving electricity from an outlet or battery may be used instead of the engine 220.

Further referring to FIG. 4, the pressure washer system 210 includes a tool, shown as pump 240, coupled to the underside of the base plate 230. The pump 240 may be a centrifugal pump, rotary pump, peristaltic pump, or other positive displacement or rotodynamic-type pump. The engine crankshaft 224 mechanically powers the pump 240, and may include additional gearing to transfer power from the crankshaft 224 to the pump 240. The crankshaft 224 interfaces with the pump 240 through the opening 270 (see FIG. 2) in the base plate 230, where the shaft 224 couples to a receiving port 244 on the top of the pump 240.

In FIG. 4 the fasteners 260, 262 are as shown as threaded fasteners, such as bolts with nuts, screws, and the like. The fasteners 260, 262 pass through holes 264, 266 in the base plate 230, where the holes 264, 266 extend through the entire thickness of the base plate 230. However, in other embodiments, the holes 264, 266 terminate within the base plate, such as with threaded holes designed to receive screws for fastening the pump 240 to the underside of the base plate 230. Other embodiments include a wide variety of releasable fasteners, such as clips, movable bars, latches, pins, other fasteners and combinations thereof.

As shown in FIG. 2, the holes 264, 266 are formed around the outer and inner peripheries of the separator protrusion 272, where the first set of three fastening holes 264 are aligned on a circular path on a first (upper) level of the base plate 230, and the second set of three fastening holes 266 are aligned on a circular path on a second (lower) level of the base plate 230. The separator protrusion 272 extends between the first set of fastener holes 264 and the second set of fastener holes 266, whereby the base of the engine 220 is vertically offset from the tool. Use of at least three fastening holes for each set helps to prevent the engine or tool from wobbling. However, in some embodiments of the invention, a single or double hole set may be sufficient. In still other embodiments, the holes may be elongate holes where the engine 220 and pump 240 click or slide into the holes for fastening.

The orientation and positioning of the interfacing portions of the engine, tool, and base plate vary depending upon the type of fastener used. For example, in the embodiment shown in FIGS. 2-4, the engine 220 is fastened to the top of the base plate 230 while the pump 240 is fastened to the bottom of the base plate 230. However, other embodiments may include powered tools and motors with flanges or hooks that attach to the opposite side of the base plate 230 from which the tool or motor rests. For example, some embodiments include an engine that attaches to both the top and bottom of the base plate 230 with sliding bars that can be rotated between locked and unlocked positions, such that a user can unfasten the motor without unfastening the corresponding powered tool.

A method for coupling a tool, such as the pump 240, and the engine 220 includes several steps. One step includes fastening the pump 240 to a first side of the base plate 230 with a series of fasteners 262. Another step includes fastening the engine 220 to a second side of the base plate 230 with an additional series of fasteners 260, where the vertical crankshaft 224 of the engine 220 extends through the opening 270 in the base plate 230, and wherein the engine 220 is fastened to the base plate 230 such that the engine 220 is able to be unfastened and removed from the base plate 230 without unfastening the pump 240. Another step includes orienting the pump 240 and the engine 220 such that the vertical crankshaft 224 engages the pump 240. Additionally, the pump 240 may be fastened to the base plate 230 so that the pump 240 is able to be unfastened and removed from the base plate 230 without unfastening the engine 220.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

The construction and arrangements of the power equipment and coupling systems as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A pressure washer, comprising:

a frame comprising tubular members;

a motor having a shaft;

a pump configured to be powered by the shaft; and a base plate fastened to the tubular members and formed from an integral sheet of solid material, wherein the base plate comprises:

a first set of fastener holes;

a second set of fastener holes; and a separator protrusion extending between the first and second sets of fastener holes, wherein the separator protrusion tapers such that the second set of fastener holes is interior to the first set of fastener holes on the base plate;

wherein the motor is coupled to a first side of the base plate via the first set of fastener holes and the pump is independently coupled to a second side of the base plate opposite to the first side via the second set of fastener holes, and wherein the shaft extends through the separator protrusion into the pump to power the pump; and wherein the base plate is configured to allow the motor to be unfastened and removed without unfastening the pump from the base plate.

2. The pressure washer of claim 1, wherein the separator protrusion is substantially conical.

3. The pressure washer of claim 2, wherein the frame has a plurality of wheels and is tiltable about the wheels to allow a user access to the pump for unfastening the pump from the base plate.

4. The pressure washer of claim 3, wherein the motor is a vertically-shafted combustion engine.

5. The pressure washer of claim 1, wherein the base plate is configured to allow the pump to be unfastened and removed without unfastening the motor from the base plate.

6. An engine-powered product, comprising:

a frame comprising tubular members;

a base plate fastened to the tubular members and formed from an integral sheet of solid material having a protrusion that is tapered such that the protrusion has a wider end and a narrower end, wherein the base plate further includes an opening formed through the narrower end of the protrusion;

a combustion engine fastened to the wider end of the protrusion of the base plate, the engine having a vertical crankshaft; and a pump fastened to the narrower end of the protrusion of the base plate, wherein the base plate further comprises a first set of apertures for fastening the engine to the base plate, and a second set of apertures for fastening the pump to the base plate, the second set of apertures within the perimeter of the first set of apertures and wherein the protrusion extends between the first set of apertures and the second set of apertures, whereby a base of the engine is offset from the pump, wherein the crankshaft extends through the opening to engage the pump, and wherein the engine may be unfastened from the base plate without also unfastening the pump from the base plate.

7. The product of claim 6, wherein a plurality of threaded fasteners fasten the pump and the engine to the base plate.

8. The product of claim 7, wherein the threaded fasteners used to fasten the pump to the base plate are inserted into a first side of the base plate, and wherein the threaded fasteners used to fasten the engine to the base plate are inserted into a second side of the base plate.

9. The product of claim 8, wherein the base plate is configured to allow for unfastening and refastening of the pump while the engine remains fastened to the base plate.

10. The product of claim 6, wherein the protrusion is substantially conical and narrows from the first set of apertures toward the second set of apertures.

11. The product of claim 10, wherein the frame has a plurality of wheels and is tiltable about the wheels to allow a user access to the pump for unfastening the pump from the base plate.

12. The pressure washer of claim 1, wherein the sheet further comprises a crease.

13. The pressure washer of claim 12, wherein the crease spans the length of the base plate.

14. The product of claim 6, wherein the base plate comprises a planar surface, wherein the protrusion angles diagonally from the planar surface to a ledge that is interior to a diagonal portion of the protrusion, wherein the ledge is parallel with the planar surface.

15. The product of claim 14, wherein the opening is formed in and encircled by the ledge of the protrusion.

16. The product of claim 14, wherein a first set of holes for fastening the combustion engine to the base plate are formed on the planar surface proximate to the wider end of the protrusion, and wherein a second set of holes for fastening the pump to the base plate are formed in the ledge.

* * * * *